United States Patent [19]

Bager

[11] Patent Number: 4,515,426

[45] Date of Patent: May 7, 1985

[54] HEAVY DUTY CLAMPING ELECTRICAL CONNECTOR

[76] Inventor: Reinhard Bager, House-No. 125, 8999 Ellhofen, Fed. Rep. of Germany

[21] Appl. No.: 586,280

[22] Filed: Mar. 5, 1984

[30] Foreign Application Priority Data

Mar. 8, 1983 [DE] Fed. Rep. of Germany ..... 3308178

[51] Int. Cl.[3] ..... H01R 13/637

[52] U.S. Cl. ..... 339/42; 339/75 R; 339/117 P

[58] Field of Search ..... 339/15, 16 R, 42, 117 R, 339/117 P, 35, 75 R, 75 M

[56] References Cited

U.S. PATENT DOCUMENTS

| | | | |
|---|---|---|---|
| 1,381,852 | 6/1921 | Tomlinson | 339/35 |
| 1,430,703 | 10/1922 | Turner | 339/35 |
| 1,490,148 | 4/1924 | Turner | 339/35 |
| 3,729,699 | 4/1973 | Briggs et al. | 339/117 P |
| 3,812,444 | 5/1974 | Reno | 339/35 |
| 4,073,562 | 2/1978 | Karlskind | 339/117 P |
| 4,363,168 | 12/1982 | Bryer et al. | 339/117 R |
| 4,390,229 | 6/1983 | Chevalier | 339/117 R |
| 4,445,536 | 5/1984 | Willis | 339/35 |

FOREIGN PATENT DOCUMENTS

| | | | |
|---|---|---|---|
| 957324 | 9/1982 | U.S.S.R. | 339/75 R |

*Primary Examiner*—John McQuade
*Assistant Examiner*—Thomas M. Kline
*Attorney, Agent, or Firm*—Parmelee, Miller, Welsh & Kratz

[57] ABSTRACT

An electrical connector device has a slot or opening therein for receiving an end portion of an electric current carrying line such as a conductor cable, wire or bus bar and, on such insertion, engage and push-back a slidable, piston-like, slidable control valve element against forwardly pressing spring-loading thereon to apply fluid pressure to and activate a clamping plunger-like latching element. The latching element engages and clamps the conductor end portion against a wall portion of the device in an efficient, electrical connecting relation within the device. Fluid, such as air under pressure may be applied continuously to the device and may, in accordance with one aspect of the invention, be continuously exhausted until an electric line is inserted for connection therein. A push-in element or plunger enables a quick release of fluid pressure and a corresponding quick release of the electric line when it is to be detached from a tight, electrically-efficient, clamping connection within the device.

16 Claims, 2 Drawing Figures

HEAVY DUTY CLAMPING ELECTRICAL CONNECTOR

BRIEF SUMMARY OF THE INVENTION

This invention relates to an electric line terminal connector device which can be employed singularly or in multiple to individually quickly, effectively and efficiently electrically connect electric lines, such as wires, cables or bus bars in a tight clamping but detachable manner to electric lines for testing and other purposes.

The construction of the device is such that a group of the devices may be placed in a side by side relation and utilized to selectively or simultaneously connect and disconnect a group of electrical lines, as for example, testing purposes. It also enables the application of line connecting pressures of a varied clamping force as particularly suited to individual requirements.

The device of the invention is constructed to take the place of conventional parts for attaching line ends which may require flat connectors, screws, bolts, etc. or soldering, brazing or welding operations, and use of core covers. The purpose has been to solve the problem that has arisen in this connection when, for example, electronic parts have to be checked electrically and/or in a definite trial order. It has been customary to electric prove line ends with flat plugs that are plugged into a corresponding plug receptacle, whereby lines of the checking arrangement are attached on the other side to the plug receptacle. As an alternate, bare line ends have been connected to a laminated spring which is in turn connected to the other side of a checking apparatus. Also, it has been known to screw-in line ends into chandelier type terminals for connecting purposes. A disadvantage of these methods, however, is that such types of terminal apparatus or arrangement are not universally applicable, and the assembling and dismantling of the electrical line ends becomes complicated, requires considerable work, and gives rise to electrical contact difficulties where different hold forces are requires from one test to another. Further, the terminal ends become damaged and the clamping force cannot be properly set or adjusted to meet particular needs. Finally, in all above prior art methods of electric line connection, a quick contact or release is not possible for the insertion and removal of inserted terminal ends from a contact or terminal device.

In view of the above, the present invention has been devised to provide an improved line terminal device which will facilitate connecting and disconnecting operations and will be more electrically efficient, adaptable, and much easier and safer to utilize.

SUMMARY OF THE INVENTION

In carrying out the invention, one electric line, such as a wire, cable or bus bar is securely connected in a permanent manner to the housing of the device when, as preferable, the device is constructed of an electrically conducting material, such as brass. Brazing, welding, soldering as well as tightened-down screw clamping means may be employed. The other electric line that is to be detachably-electrically connected to the terminal device is inserted within an entry bore in the housing of the device in such a manner as to engage a somewhat lightly spring-loaded, slidable, piston-like control valve that is operatively mounted within a control chamber defined by a backward extension of the entry bore. The control valve is then moved backwardly by such engagement to advance it to a pressure fluid utilizing position at which fluid under pressure, such as air, is applied to an operating chamber to activate and advance a clamping plunger across the entry bore into a clamping, electrically efficient, contacting engagement with a bare end portion of the electric line that has been thus inserted.

When the detachable end of the line is to be removed and disconnected, this can be effected in a simple and quick manner by a push release element or plunger which functions to immediately release fluid pressure from the operating chamber for the clamping plunger and permit the clamping plunger to withdraw within its operating chamber under spring loaded pressure. At this time, the end portion of the electric line may be pulled out of position within the entry bore of the device, and the fluid control valve or element will then be moved back to its original or forward position under its tension spring-loading. The return or forward movement of the control valve element may be employed to provide an outflow of fluid under pressure through an exhaust muffler to the atmosphere.

In a second embodiment of the invention, the control valve may, as in the case of the first embodiement, in its forward position, serve to divert fluid under pressure being supplied to the device to an exhaust muffler and, upon its inward movement as induced by the entry of a bare end portion of the electric line to be attached, will direct fluid under pressure from an inlet passageway through a connector line to the operating chamber for the clamping plunger. In the first embodiment, such flow is within the device, itself, through a cross-extending passageway. Release of clamping pressure will be effected in the same manner in the embodiment of FIG. 2, although for the purpose of simplification in the drawings, the pushbutton release element and its attendant part of FIG. 1 are not shown.

Figure 1:
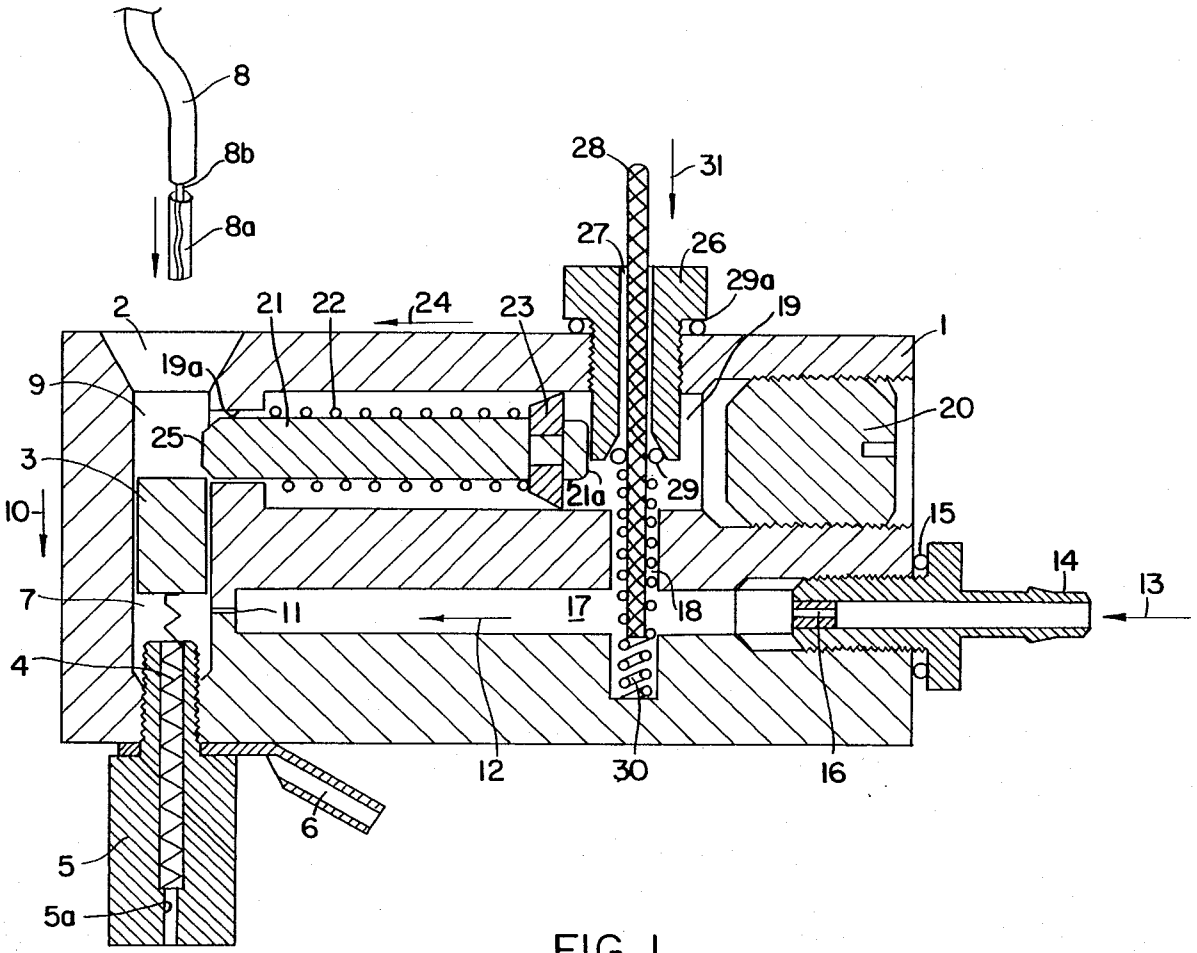
FIG. 1 is a section through a device constructed in accordance with the invention in a "ready" position for receiving the bare end of an electrical line or cable.
Figure 2:
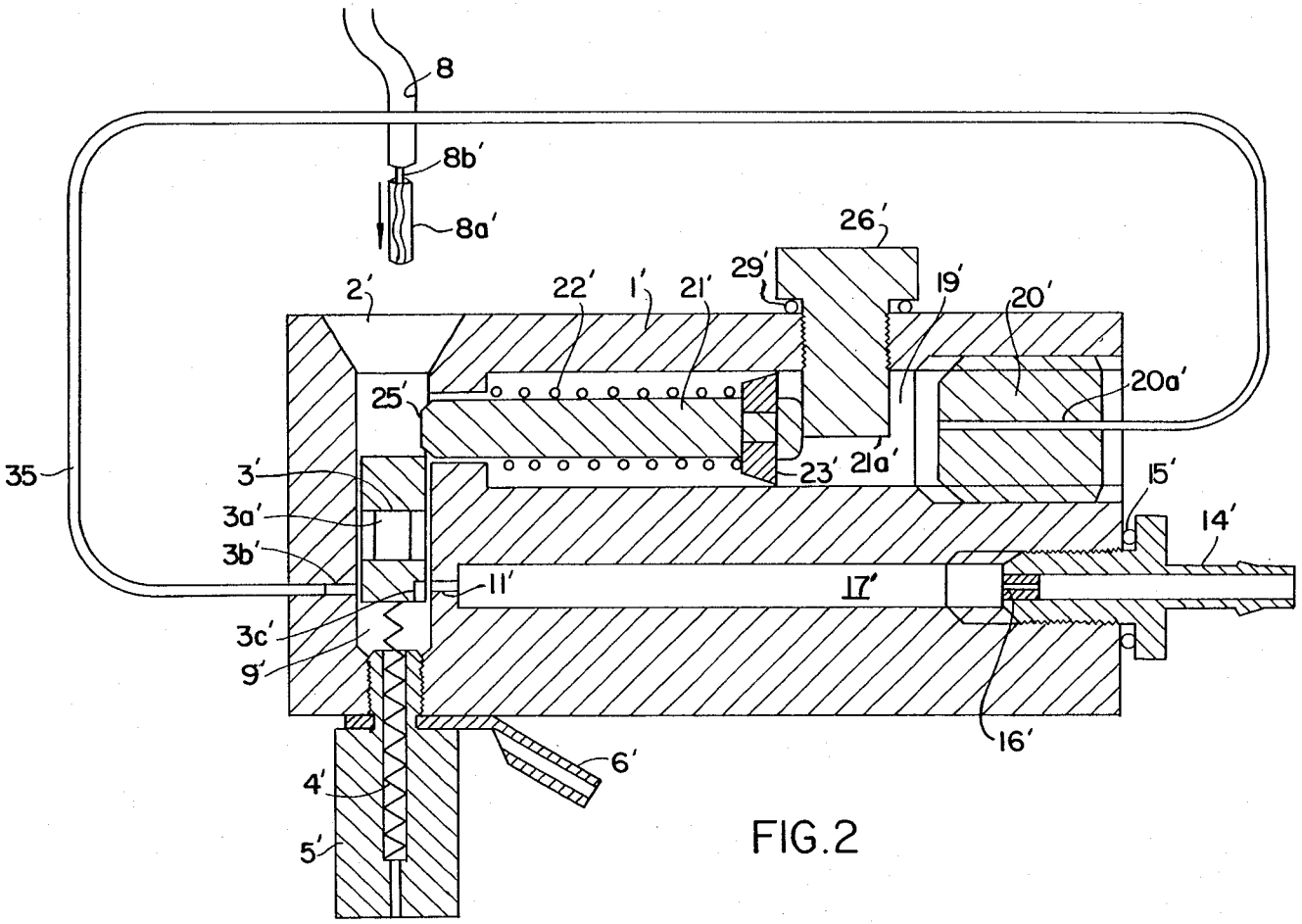

And, FIG. 2 is a view similar to FIG. 1 showing a modified embodiment of the invention.

DETAILED DESCRIPTION OF THE EMBODIMENT

Referring to FIG. 1 of the drawings, a device of this embodiment of the invention is provided with a housing 1 which may be of good conducting material, such as brass or other metal.

If the housing 1 is made of a synthetic or non-conducting material, it may be provided with a thin copper, brass or aluminum sleeve or collar (not shown) inserted into the bore 9 and electrically connected to the connector 6 in a permanent manner. However, it is preferred to make the housing 1 of a suitable conductor metal, such as mentioned above.

The cone-shaped, outwardly diverging portion of the entry bore 2 extends backwardly into a cylindrical wall of bore 9 that defines a clamping zone and then a valve operating zone 7 that together provide a cross-extending control chamber that is shown open at its back end to receive an exhaust muffler 5. A slidable, piston-like control valve or element 3 is operatively mounted in the chamber of the bore 7 and is adapted to be moved backwardly therein against spring-loading that is effected by a tension spring 4. The spring 4 abuts against a back end of the control valve 3 and extends along a central longitudinal bore within the exhaust muffler 5 to, at its back end, abut against a ledge portion that is defined by an exhaust passage 5*a* of reduced diameter.

As shown, the muffler 5 is threadably mounted to extend within a reduced, threaded, open, opposite end portion of the bore 7 of the control chamber to limit the maximum backward movement of the control valve 3 therein, and to securely mount and retain line-mounting connector 6 in electrical contact with the conducting metal of the housing 1. Open, reduced end bore in the muffler 5 provides the exhaust passage 5*a* through which pressure fluid may be exhuasted when the device is not in operation from the standpoint of electrically clamping an electric line in the clamping zone of the terminal receiving bore 9. The spring 4 has a relatively slight or light tension in order that the valve 3 will be easily moved backwardly into abutment with a front end of the muffler 5 from its forward position of FIG. 1 when engaged by a bare wire end portion 8*b* of an electric line 8. The end 8*b* may be of a wire strand, a braid, a solid piece or a bus bar. It will be noted that electric line 8 has its end sheathing 8*a* slit therealong in position to be removed before the bare end 8*b* is inserted within the device.

Again referring to FIG. 1, fluid or air under a suitable, desired compression, as effected by a conventional compressor, is introduced in the direction of arrow 13 into a connector inlet or nozzle 14 which is threadably mounted within an enlarged end of a longitudinally-extending inlet passageway 17 in the housing 1. The nozzle 14 is shown sealed-off in its threaded mounting position by an O-ring gasket 15. An inlet port element 16 of reduced diameter is carried in the forward end of the inlet nozzle 14 to direct fluid under pressure (pressure fluid) in the direction of arrow 12 along the inlet passageway 17, and out through an outlet port 11 at the front end thereof.

It is emphasized that in this embodiment, the flow size or diameter of the inlet port 16 should be less than the size or diameter of the outlet port 11, the importance of which will now be discussed. By way of example, the port 16 may be of a diameter of 0.4 mm, while the port 11 may be of a diameter of 1 mm.

Normally, in the embodiment of FIG. 1, when the control piston or valve 3 is in its forward position, flow of pressure fluid in the direction of the arrow 13 through the port 16 and along the passageway 17, is preferentially, as indicated by arrow 12, out through the port 11 into the operating chamber of the bore 7, and then out through the open end passage 5*a* of the muffler 5. This is true although, as shown, a cross-connected bore or passageway 18 extends from the inlet passageway 17 to an operating chamber 19. This is enabled by making the outlet port 11 of a larger effective flow size than the inlet port 16. Thus, fluid or air that enters the passageway 17 will have a full exhaust or relief flow path of minimum resistance, such that it will not be able to activate a clamping plunger 21 that is slidably positioned in the operating chamber 19.

However, when the control piston 3 is moved down by physical contact with an introduced bare end portion 8*b* of an electric line 8 against tension of the spring 4 (which may be about 5 to 10 g), it will close-off the port 11 and thus cause full pressure of the fluid to be applied along the cross bore of the connecting passageway 18 into the back end of operating chamber 19. The pressure fluid, upon entering the chamber 19 then forces the clamping plunger 21 forwardly therewithin and into a tight contacting relation with conductor end 8*b* to force it against an opposite wall portion of the bore 9. The amount of pressure supplied by compression of the fluid may be varied to provide any suitable clamping force to the plunger 21. As long as the control valve 3 is in its inward or back position within the chamber 9, a positive, electrically efficient clamping action will be effected by the plunger 21 which is applied through the agency of a piston head or gasket 23 shown as of cone shape and mounted on a back end portion of the clamping plunger 21.

The front end portion 19*a* of the operating chamber 19 has a reduced diameter to guidably-slidably receive the front end portion of the clamping plunger 21 therein. Spring-loading of the plunger 21 is provided by a tension spring 22 which, at its front end, is secured to the plunger as by weld metal and, at its back end, abuts the piston-like gasket 23. The gasket 23 is secured on the back end portion of the plunger 21 by an abutting threaded mounting pin 21*a*. The back end of the piston is limited as to its maximum backward position within the operating chamber 19 by abutment of the pin 21*a* with a hollow, plug-like bolt or screw element 26 that is threadably mounted within the housing 1 to extend transversely into the back end of the operating chamber 19. Backward or return movement of the plunger 21 as effected by its spring-loading is thus limited. Fluid pressure may be applied as an optimum with a range based on a kilogram, with the plunger 21 having a moving force applying piston head or gasket 23 of a diameter of about 8 mm. It will be appreciated that fluid pressure may be varied over a wide range as determined by requirements as to the nature or size of the conductor that is to be detachably connected to the device as well as the electric voltage current that is to be applied thereto.

The hollow-plug-like bolt 26 is mounted in a fluid sealed-off relation by a ring gasket 29*a* to extend within a threaded cross bore in the housing 1 and into the operating chamber 19. As shown in FIG. 1, the bolt 26 has a center bore 27 extending longitudinally centrally through it and open into the operating chamber 19. The bore 27 terminates in a forwardly diverging, conical-shaped portion which is adapted to receive an O-ring type of gasket 29 that functions to normally seal and close-off fluid flow into the bore 27. However, when it is desired to quickly, substantially instantaneously release the clamping engagement of the plunger 21 at its forward head end 25 from a tight, fluid-pressure-held abutment with an electric conductor end portion 8*b*, a mere pressing-in of a plunger-like element or tapper 28 is effected. This moves the gasket 29 into a releasing relation with respect to flow of pressure fluid out through the center bore 27. Normally, the gasket 29 is held in a tight, fluid sealing-off position within the conical mouth of the bore 27 by a tension spring 30. It will be noted that the spring 30, at one end engages the gasket 29, and at its other end, extends along the connecting cross bore of connecting passageway 18 to abut its closed-off back end.

To facilitate the assembly, maintenance and repair of the operating parts of the device, a closure plug or screw 20 is adapted to be threadably secured within a back, enlarged open end extension of the operating space or chamber 19.

In the embodiment of FIG. 2, for simplicity of description, parts and elements corresponding to those in the embodiment of FIG. 1 have been given prime suffixes. Some of them are substantially or exactly like those in the first embodiment and others, as shown, are somewhat different. Although plug 26' has been shown as a solid plug, it will be of the same construction, use and mounting as the plug 26 of FIG. 1 and will also be provided with a similar push-in, compression fluid release element 28.

In the embodiment of FIG. 2, the control piston 3' has a central, reduced diameter portion 3a' which serves as a fluid control bypass area when the valve 3' is moved by the introduction of a bare end portion 8' of an electric line inwardly into a position at which the portion 3a' is in line with the outlet port 11', across from an inlet end or port 3b' of a connector pipe or tubing member 35. The connector member 35 is connected at its opposite end to a passage 20a' in closure plug 20' that leads into operating chamber 19'. The connector 35 takes the place of the connecting cross passageway 18 of the embodiment of FIG. 1. In the embodiment of FIG. 2, the cross passageway 18 is thus eliminated from the standpoint of providing a pressure fluid flow passageway to the operating chamber 29 from inlet passageway 17'.

When the control element or valve 3' of FIG. 2 is in its normal spring-pressed forward position shown, pressure fluid being introduced into the inlet passageway 17' will exit through outlet port 11' and an angular side port 3c' in the control valve 3', into the back end of the bore 9' of the control chamber and out through the muffler 5'. However, if no release of fluid pressure is desired when the terminal device is not at the time being used for detachably connecting an electric line thereto, the side port 3c' may be omitted to thus close-off the outlet vent 11'.

The terminal device of the invention enables the application of a selected constant clamping force, the electric line may be clamped and connected over a large area of its surface, and the clamping force may be selected to suit particular requirements. Also, high tension current conductors carrying 10 to 20 or more ampheres can be serviced without overloading, sparking or other adverse effects. It will be appreciated that the diameter of the entry bore 2 and of the clamping bore wall 9 may be selected on the basis of the shape, size or range of size of the conductors that are to be connected to the device.

I claim:

1. A quickly-connected and detached electrical terminal device of an electric conductor which comprises, a housing, an entry bore defining a latching chamber in said housing for introducing a bare end portion of the electric conductor therein, said entry bore extending backwardly along said housing to define a control chamber therein; a slidable control element operatively positioned in and normally urged within said bore to a forward position therein for engagement by the bare end portion of the conductor when it is inserted within said bore, and under further inward movement of said end portion of the conductor, for backward movement within said bore; an inlet passageway along said housing connected to a back end of said latching chamber and adapted to receive an operating fluid under pressure, an operating chamber within said housing open at its forward end to said latching chamber forwardly of said control element, a clamping plunger operatively positioned in said operating chamber and normally urged to a backward position therein, said clamping plunger being adapted for movement into and out of latching engagement with an inserted bare end portion of the conductor, means connecting said inlet passageway to said operating chamber, and said slidable control element having means for diverting fluid flow under pressure from said inlet passageway to said operating chamber when said control element is in a forward position within said bore and for causing fluid flow under pressure from said inlet passageway along said connecting means to said operating chamber for advancing said clamping plunger forwardly into latching engagement with an inserted bare end portion of the electrical conductor when said control element is moved backwardly within said bore by the inserted bare end portion of the conductor.

2. An electrical terminal device as defined in claim 1 wherein, said slidable control element is a piston-like valve, and spring means cooperates with said valve for normally urging said valve towards and maintaining it in its forward position within said entry bore.

3. An electrical terminal device as defined in claim 1 wherein said clamping plunger has a pressure head positioned on its back end portion, and said pressure head has a slidable fit within said operating chamber to advance said clamping plunger under fluid pressure applied thereto forwardly within said operating chamber into clamping engagement with an inserted bare end portion of the electric conductor.

4. A device as defined in claim 1 wherein, said operating chamber has a smaller diameter portion connecting it to said latching chamber, said clamping plunger has a reduced forward end portion slidably-guidably mounted to extend along said smaller diameter portion, said plunger has a body of a diameter that is less than the diameter of a back portion of the said operating chamber, spring means is positioned along said body to normally urge and maintain said plunger in a backwardly withdrawn position with respect to said latching chamber, and a fluid pressure-sensitive gasket is mounted on a back end portion of said clamping plunger and has a slidable sealing fit within the back portion of said operating chamber.

5. A device as defined in claim 1 wherein, said clamping plunger is spring-loaded for backward movement out of engagement with an inserted bare end portion of the electric conductor, fluid pressure release means is mounted in said housing and connected to said operating chamber for quickly exhausting fluid under pressure from said operating chamber, whereby said clamping plunger will be moved backwardly under its spring-loading out of clamping engagement with the bare end portion of the electric conductor.

6. A device as defined in claim 5 wherein, means cooperates with said pressure release means for normally closing-off outflow of the pressure fluid from said operating chamber.

7. A device as defined in claim 5 wherein, said fluid pressure release means comprises: a plug having an exhaust bore therealong defining an exhaust passageway, said exhaust bore has an enlarged inner end portion, a sealing gasket is positioned in said enlarged end portion to normally close-off flow of pressure fluid from said operating chamber through said exhaust passageway, said pressure release means being spring-loaded to normally maintain said sealing gasket in a closing-off position with respect to said exhaust passageway, and said pressure release means being adapted to be pushed inwardly to move said sealing gasket into an open fluid-bypassing position within said enlarged inner end portion to exhaust pressure fluid from said operating chamber and thereby move said clamping plunger backwardly out of clamping engagement with an inserted bare end portion of the electric conductor under its said spring-loading.

8. A device as defined in claim 5 wherein, said connecting means is a cross passageway connecting a back end portion of said operating chamber with said inlet passageway, and said pressure release means is a push-in plunger extending at its inner end along said cross passageway, an exhaust passageway connected to said operating chamber, and spring means is positioned along said plunger to engage a closed back end portion of said cross passageway for normally urging said clamping plunger forwardly into a closing-off of said exhaust passageway.

9. A device as defined in claim 1 wherein, said inlet passageway is connected within said housing to said control chamber, an exhaust means is connected to a back end of said control chamber, and said slidable control element is a control valve adapted to open fluid flow from said inlet passageway to said exhaust means when it is in its forward position within said control chamber and to enable fluid flow from said inlet passageway to said operating chamber when it is in its backwardly moved position within said control chamber.

10. A device as defined in claim 9 wherein, connector means connects said inlet passageway to said operating chamber, and said control valve is adapted to cause a by-passing of fluid pressure flow from said inlet passageway to said operating chamber when said control valve is in its backward position within said control chamber.

11. A device as defined in claim 10 wherein, said inlet passageway has a pressure fluid entry port and has a fluid outlet port connected to said control chamber, said control valve is adapted to open said outlet port from said control chamber to said exhaust means when said control valve is in its forward position within said control chamber, said outlet port has a larger effective flow diameter than said entry port to divert fluid pressure flow under such a condition away from said connector means and out through said outlet port to said exhaust means, and said valve means is adapted to close-off fluid pressure flow through said outlet port and cause flow through said connector means when said valve means is in its backward position within said control chamber.

12. A device as defined in claim 9 wherein, connector means for the pressure fluid extends from said control chamber to said operating chamber, said control valve is adapted to close-off flow of pressure fluid from said inlet passageway across said control chamber to said connector means when it is in its forward position within said control chamber, and said control element has means to enable fluid flow under pressure from said inlet passageway to said connector means when it has been moved to its backward position within said control chamber by the insertion of a bare end portion of the conductor into said entry bore.

13. A device as defined in claim 12 wherein, an outlet port connects a forward end of said inlet passageway to said control chamber, and said control valve has an offset portion to pass fluid under pressure through said port to said exhaust means when said control element is in its backward position within said control chamber.

14. A device as defined in claim 13 wherein, said control valve is a piston-like valve slidably operatively positioned within said control chamber, and said valve has a central portion of reduced diameter that is adapted to be aligned between said port and said connector means when said control valve is in its backward position within said control chamber.

15. A device as defined in claim 1 wherein an outlet port is connected from a front end of said inlet passageway to said control chamber, an inlet nozzle is connected to a back end of said inlet passageway and has an entry port therein of a smaller effective fluid flow diameter than said outlet port to assure preferential flow of pressure fluid through said outlet port to said exhaust means when said control valve is in its forward position within said control chamber.

16. A device as defined in claim 1 wherein, a cross connecting passageway extends between said inlet passageway and said operating chamber for supplying fluid under pressure to said operating chamber, said control element is a piston-like slide valve, an inlet nozzle is connected to a back end of said inlet passageway for supplying fluid under pressure thereto, said nozzle has an inlet port open to said inlet passageway, an outlet port is connected between a front end of said inlet passageway and said control chamber and has an effective larger size opening therethrough than said inlet port, said control chamber at its back end has an exhaust muffler for discharging pressure fluid therefrom back of said slide valve, said slide valve is positioned in said control chamber for opening fluid flow from said outlet port to said exhaust muffler when said control element is in its forward position within said control chamber, said outport has an effective greater flow diameter than said inlet port to preferentially exhaust fluid under pressure from said exhaust muffler when said slide valve is in its forward position in said control chamber rather than through said cross-extending passageway.

* * * * *